US007784313B2

(12) United States Patent
Wyers

(10) Patent No.: US 7,784,313 B2
(45) Date of Patent: Aug. 31, 2010

(54) CABLE LOCK APPARATUS AND METHOD

(76) Inventor: Philip W. Wyers, 14705 E. Aberdeen Ave., Centennial, CO (US) 80016

( * ) Notice: Subject to any disclaimer, the term of this patent is extended or adjusted under 35 U.S.C. 154(b) by 320 days.

(21) Appl. No.: 11/791,591

(22) PCT Filed: Nov. 2, 2005

(86) PCT No.: PCT/US2005/040009

§ 371 (c)(1),
(2), (4) Date: May 24, 2007

(87) PCT Pub. No.: WO2006/060112

PCT Pub. Date: Jun. 8, 2006

(65) Prior Publication Data

US 2008/0148789 A1 Jun. 26, 2008

Related U.S. Application Data

(60) Provisional application No. 60/625,177, filed on Nov. 2, 2004.

(51) Int. Cl.
*E05B 67/06* (2006.01)
*E05B 73/00* (2006.01)

(52) U.S. Cl. ..... 70/49; 70/14; 70/19

(58) Field of Classification Search ..... 70/14, 70/18–20, 25, 30, 31, 34, 49, 57, 58, 233, 70/416; 24/115 G
See application file for complete search history.

(56) References Cited

U.S. PATENT DOCUMENTS 1,386,778 A * 8/1921 Gray ..... 70/49
3,855,824 A * 12/1974 Falk ..... 70/38 A
3,987,653 A * 10/1976 Lyon et al. ..... 70/19
5,277,599 A * 1/1994 Nilson ..... 439/133
5,517,835 A * 5/1996 Smith ..... 70/14
5,786,759 A * 7/1998 Ling ..... 340/542
5,791,170 A * 8/1998 Officer ..... 70/49
5,937,678 A * 8/1999 Kuo ..... 70/18

(Continued)

OTHER PUBLICATIONS

International Searching Authority Notification of Transmittal of the International Search Report and the Written Opinion of the International Searching Authority, or the Declaration) dated Sep. 19, 2006.

*Primary Examiner*—Peter M Cuomo
*Assistant Examiner*—Alyson M Merlino
(74) *Attorney, Agent, or Firm*—Holland & Hart LLP

(57) ABSTRACT

The present cable lock apparatus and method, including a cable having a first end terminated with a shackle, and a lock body providing a throughway to receive the cable in sliding relation such that the lock body may be selectively positioned along the length of the cable. The shackle portion is received within the lock body, and is removable therefrom. A first plunger grip assembly is used to receive the shackle portion and the cable length in a sliding relationship. The first plunger is depressed to a release state, allowing the cable to slid through the lock body, and is released to a grip state. The method of securing an item with the present lock apparatus broadly includes passing the cable through the lock, advancing the lock body along the cable, forming a loop around the item, and securing the first end of the cable to the lock body.

23 Claims, 5 Drawing Sheets

U.S. PATENT DOCUMENTS

| | | | | |
|---|---|---|---|---|
| 5,960,652 | A * | 10/1999 | Marmstad | 70/49 |
| 6,257,029 | B1 * | 7/2001 | Liao | 70/58 |
| D457,802 | S * | 5/2002 | Meekma et al. | D8/333 |
| 6,470,718 | B1 * | 10/2002 | Yang | 70/30 |
| 6,508,086 | B2 * | 1/2003 | Chen | 70/49 |
| 6,609,399 | B1 * | 8/2003 | Daniels, Jr. | 70/49 |
| 6,629,440 | B1 * | 10/2003 | Meekma et al. | 70/49 |
| 6,681,603 | B1 * | 1/2004 | Yu | 70/18 |
| 2003/0196462 | A1 * | 10/2003 | Chen | 70/49 |

* cited by examiner

CABLE LOCK APPARATUS AND METHOD

BACKGROUND

Over the years, there have been numerous variations of locking devices for a multitude of applications. Typically, a locking device is used to secure objects together, whether it be two independent items, a door for an enclosure, or the like. Moreover, a wide variety of locking mechanisms have been employed, including key actuated locks and combination locks, all of various constructions.

A widely used locking device is known as a padlock. The prior art padlock works adequately for a number of conventional applications wherein the span of objects to be secured is relatively short or where the span can be fitted with a hasp. However, numerous shortcomings of padlocks become apparent when a padlock is sought to be used in applications wherein two objects of thick cross-sections are to be secured or where the objects to be secured are separated by a relatively large distance.

There are numerous applications where items of value must be secured over a distance or are too large to lock with a padlock. Some examples of such applications include patio furniture, toolboxes, welding equipment, compressors, ladders, and landscaping equipment. Furthermore, as the popularity of recreational equipment such as ATV's, motorcycles, go-karts, snowmobiles, watercraft, bicycles, skis, and snowboards has grown, so to has the need for a versatile, convenient, and economical way of securing those items against theft whether they are on a trailer, a roof rack, or left at a job site.

The classic solution to the shortcomings of the padlock in these applications is to use a padlock in combination with a cable that has eyelets on each end whereby the cable may be looped around and through the objects to be secured and then looped through one of its eyelet ends. However this solution has its own shortcomings.

One shortcoming of the padlock and cable combination is that the padlock can rattle and cause damage to the secured cargo. The padlock is loose on the eyelet or around the cable and therefore is not prevented from swinging and vibrating. This is an issue especially in hauling applications where vibration and bouncing are common. Furthermore, a cable and padlock combination does not provide a means to adjust the size of the loop around the item(s) to be secured. An adjustable loop is a desirable feature as it could provide a means to hold down cargo as well as secure it against theft. In addition, adjusting or cinching the loop tight against the cargo would further prevent damage to the cargo by eliminating slack thereby preventing rubbing and chaffing that can occur between an item and the lock or cable.

Therefore there remains a need for a locking device operative to secure items of value whether in transit or in place that allows for locking over a large distance and is cinchable, versatile, and preferably encased in a soft material to further prevent any damage to the valuable cargo sought to be secured.

SUMMARY OF THE INVENTION

One aspect of the exemplary embodiment described herein is to provide a new and useful cable lock apparatus and method that is versatile in its applications for securing items.

Another aspect of the exemplary embodiment is to provide a cable lock that not only secures an end portion of the cable but also receives a central section of the cable for sliding movement therealong.

It is a further aspect of this embodiment to provide a way of selectively securing the lock body along the length of the cable.

Still another aspect of the exemplary embodiment is to provide a cable body that tends to grip a cable received therethrough.

Still a further aspect of the disclosed embodiment is to provide a cable lock having a cable body of simple construction that is easy to manufacture yet durable in use.

Accordingly, the invention described herein is illustrated by a representative exemplary embodiment. In this embodiment, a lock apparatus is provided that includes an elongated flexible cable that has a first end portion and an opposite second end portion defining a length therebetween. A shackle portion is affixed to the first end portion. A lock body is provided with the lock body having a throughway that is sized and adapted to receive the cable in sliding relation such that the lock body may be selectively positioned along the length of the cable. The lock body has a shackle opening that is sized and adapted to receive the shackle portion in an engaged state with the shackle portion removable therefrom to define a disengaged state. A latch assembly is disposed in the lock body and includes a latch member moveable between a latch state and unlatch state. When the shackle portion is in the received state, that latch member is operative in the latch state to engage the shackle portion thereby to lock the shackle portion relative to the lock body. When the latch member is moved to the unlatch state, the shackle portion is released so that the shackle portion may be disengaged from the lock body. The lock assembly is disposed in the lock body and is moveable between a lock position and an unlock position such that, when the lock assembly is in the lock position, the latch member is placed in the latch state. When the lock assembly is moved to the unlocked position, the latch member is advanced from the latch state to the unlatched state.

One aspect of this exemplary embodiment is to provide a grip assembly disposed in the lock body. The grip assembly includes a grip member moveable between a grip state when the lock body is secured along the cable at a selected position and a release state wherein the lock body may be advanced along the cable when the cable is received in the throughway. In the exemplary embodiment, the grip member is biased toward the grip state, and the latch member is biased toward the latch state. Another aspect of the present invention is to provide a stop head on the second end portion of the cable. The stop head is sized so that it may not pass through the throughway. In the exemplary embodiment, the stop head is defined by a closed loop portion of the cable. According to another aspect, the shackle portion when in the engaged state, is biased toward the disengaged state.

In its more detailed configuration, the lock body has a slideway formed therein with the slideway intersecting the throughway. The grip member is then a first plunger slideably received in the slideway and slideably removable between the grip state and the release state. This first plunger has a bore formed transversely therethrough that is sized and adapted to pass the shackle portion therethrough an to receive the cable in sliding relationship. Thus, when the first plunger is in the release state, the bore aligns with the throughway whereby the cable may slide through the lock body and through the first plunger. However, when the first plunger is in the grip state, the bore is offset from the throughway thereby resisting sliding movement of the cable through the lock body and the first plunger. Moreover, a second plunger may be disposed in the slide way and is moveable relative to the first plunger between a retracted position and an advanced position. The shackle portion is operative to move the second plunger to the retracted position when in the engaged state. This prevents the first plunger from moving from the grip state to the release state. The second plunger is biased toward the advanced position by a spring interposed between a first and second plungers.

The latch member is disclosed to be a latch plate that slides in the lock body. This latch member is biased toward the latch state, again by a suitable spring. A rotatable cam element is provided so that rotation of the cam element in a first direction advances the latch member from the latch state to the unlatch state. Rotation of the cam is provided by means of a rotatable lock core forming part of the lock assembly.

The lock body in this embodiment is configured as a generally disc-shaped structure having opposite generally parallel front and back surfaces and a cylindrical side surface therebetween. The lock body is formed by first and second mating sections. The throughway is then defined by a first bore extending between two locations on the side surface, preferably along a cord of the disc-shaped structure. The shackle opening is formed through the side surface at a third location. In this embodiment, the shackle opening is a bore formed radially in the disc-shaped member and generally perpendicularly to the throughway. The lock assembly is preferably key actuable and is mounted through the front surface of the disc shaped lock body. A covering extends around a portion of the lock body with this covering being disclosed as a soft grip material.

The disclosed embodiment of the present invention further contemplates a method of securing an item with an elongated cable. This method broadly includes, but in no particular order, a step of passing a first end of a cable through a lock body. The lock body is advanced along the cable to a selected position. A portion of the cable is formed into a loop with this loop engaging the item so as to prevent the removal of the item therefrom. The first end of the elongated cable is then lockably secured to the lock body to define a lock state so that the item cannot be disengaged from the loop. The lock body is also secured against movement along the cable when in the locked state. Further, according to the disclosed embodiment, the cable has a closed loop formed on a second end thereof. The step of forming a portion of the cable into a loop while engaging the item with the loop is accomplished by looping the cable around the item and then passing the first end of the cable to the closed loop. The method may also secure the item to a second item by first looping the cable around the first item and passing the first end of the cable through the closed loop. Thereafter, the cable is looped around the second item, and the first end of the cable is lockably secured to the lock body.

These and other aspects of the exemplary embodiment of the present invention will become more readily appreciated and understood from a consideration of the following detailed description of the exemplary embodiment when taken together with the accompanying drawings, in which:

DETAILED DESCRIPTION OF THE EXEMPLARY EMBODIMENTS

Figure 1:
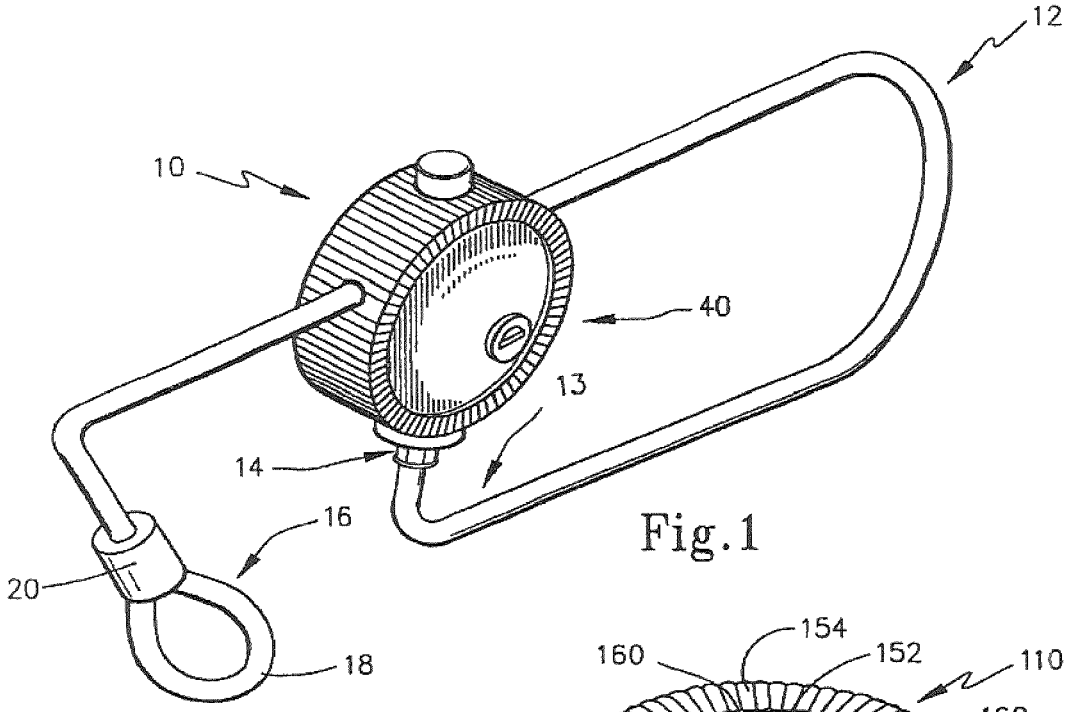
FIG. 1 is a perspective view of a lock apparatus in the form of a cable lock according to the exemplary embodiment of the present invention.

The present invention broadly concerns a lock apparatus but more particularly is directed to a cable lock apparatus that is operative to secure one or more items. The exemplary embodiment which illustrates the invention broadly includes a lock body and an elongated cable which lockably secures to the lock body. Accordingly, the lock apparatus according to the exemplary embodiment is introduced in FIG. 1 where it may be seen that lock apparatus or cable lock 10 includes an elongated cable 12 that is secured by a lock body 40 that receives a central portion of cable 12. Cable 12 can be of any desired length and has a first end portion 13 provided with a shackle portion 14. A second end of cable 12 terminates in a lock head 16 formed by a small closed loop 18 of the cable. A fitting 20 mounts on cable 12 so that loop 18 is permanently formed thereon. Such fittings 20 are of the type well known in the art.

Figure 2:
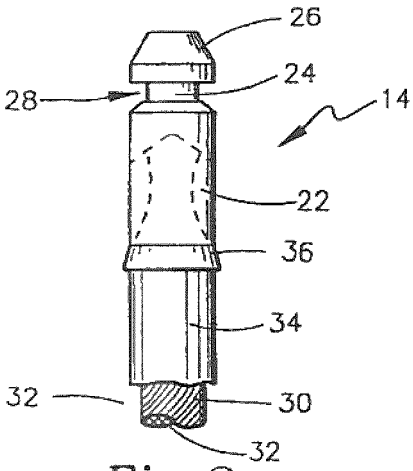
FIG. 2 is a side view in elevation of the shackle portion of the cable of FIG. 1.

Shackle portion 14 is illustrated in greater detail in FIG. 2. Here, it may be seen that shackle portion 14 includes a cylindrical shell 22 which terminates in a post 24 and an enlarged latch head 26 so that there is an annular groove 28 extending around the shackle portion 14 between shell 22 and latch head 26. Cable 12, on the other hand, is any suitable cable but, in the exemplary embodiment, is a woven cable 30 formed by a plurality of braided strands 32 and is constructed of a suitable flexible steel material. Each of braided strands 32 is formed by a plurality of individual wires which are braided together. A flexible plastic covering 34 extends around cable 30 and is retained by flange 36 at the bottom of cylindrical shell 22. Cable 30 extends into shell 22 so that shell 22 may be crimped, again as known in the art, to secure shackle portion 14 and cable 30 together in such manner as to prevent their normal separation.

Figure 3:
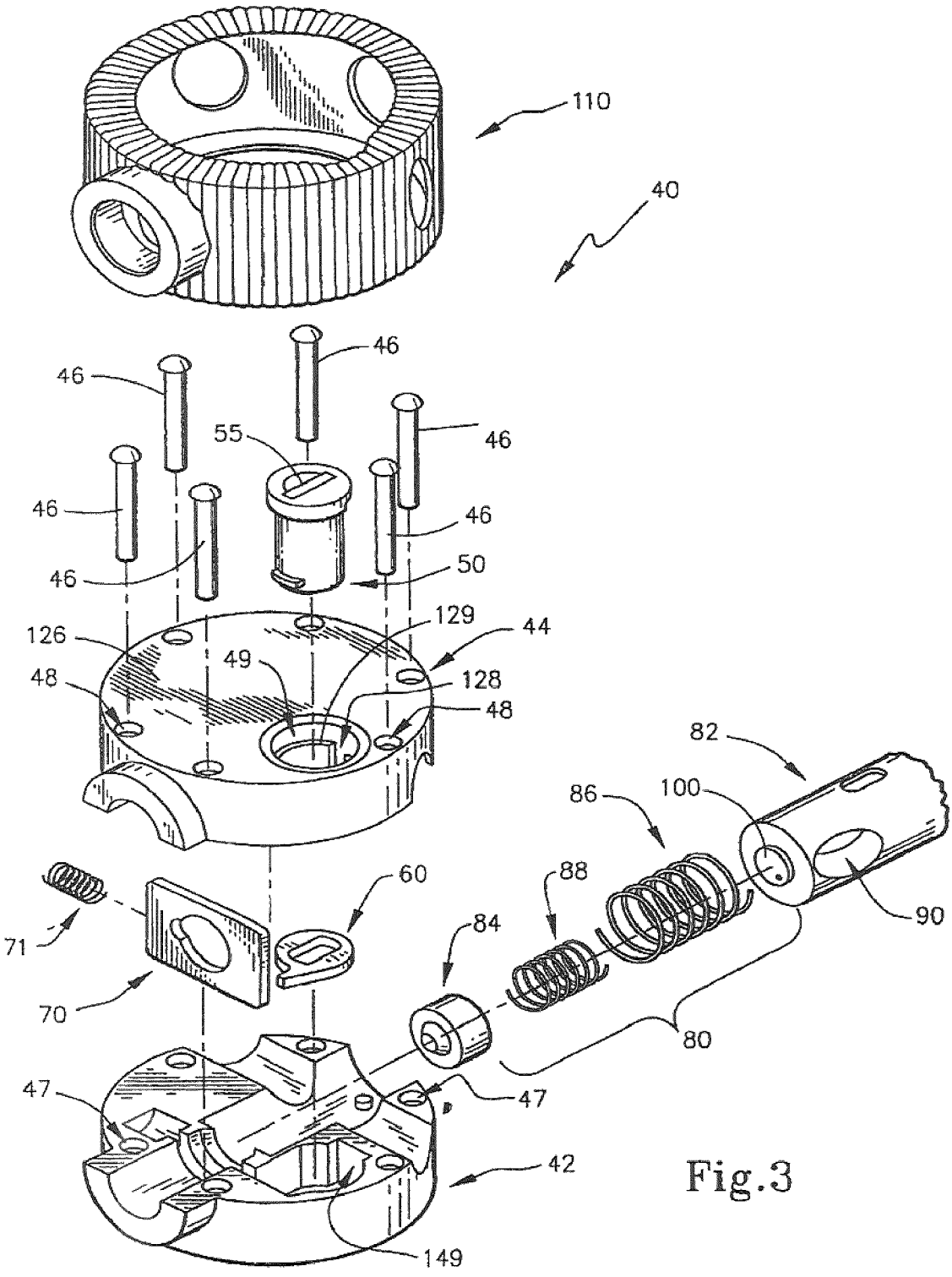
FIG. 3 is an exploded perspective view of the lock head of the cable lock of the exemplary embodiment.

The construction of lock body 40 is illustrated in the exploded perspective view in FIG. 3. Here, it may be seen that lock body 40 according to the exemplary embodiment of the invention is generally disc-shaped in configuration and is formed by first and second mating sections so that there is a back section 42 and a front section 44. Lock body 40 mounts the various components which make up a grip assembly, a latch assembly and a lock assembly that are operative to secure cable 12 to lock body 40. These components include a lock assembly 50, a rotatable cam element 60, a latch member in the form of a slide plate 70 and a grip assembly 80 that includes a grip member in the form of a first plunger 82, a second plunger 84 and biasing springs 86 and 88. Biasing spring 71 is associated with slide plate 70. A plurality of rivets 46 extend through holes 47 and 48 respectively formed through back section 42 and front section 44 so as to secure the front and back sections together. An annular cover 110 extends over the lock body when back section 42 and front section 44 are secured together with cover 110 being formed of any suitable material, such as a soft grip plastic. As is further seen in FIG. 3, lock assembly 50 mounts through an opening 49 formed generally perpendicularly in the front surface of front section 44.

Figure 4:
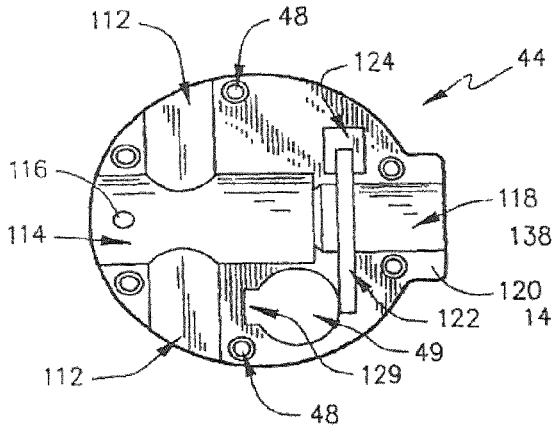
FIG. 4 is a top plan view of a front section forming the lock body according to the exemplary embodiment.
Figure 5:
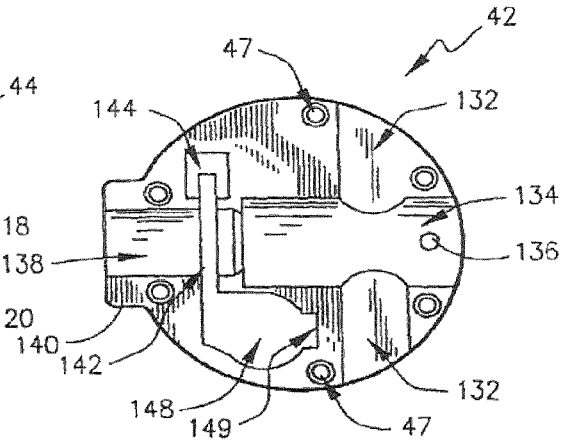
FIG. 5 is a top plan view of a back section of the lock body.

Front section 44 of lock body 40 is illustrated in greater detail in FIG. 4, and back section 42 is illustrated in greater detail in FIG. 5. With reference to FIGS. 4 and 5, and with continued reference to FIG. 3, it may be seen that front section 44 and back section 42 are, with some exception, formed substantially as mirror images of each other and provide various cavities, bores, a slideway and a throughway, which, when mated together, mount to various components of lock head 40. Accordingly, with reference to FIGS. 3 and 4, it may be seen that front section 44 includes a trough 112 having a half circular cross-section with trough 112 extending between first and second locations around the perimeter of front section 44 generally along a cord thereof. A semi-circular half bore 114 is formed radially of front section 44 and is generally perpendicular to trough 112 and spaced from the first and second locations. An upright post 116 is located on the bottom surface of half bore 114 proximate to the outer edge of front section 44. A half bore 118 of smaller radius extends radially into front section 44 through a boss 120 and is axially aligned with and communicates with half bore 114. A rectangular channel 122 intersects half bore 118 and is generally perpendicular thereto. A half cylindrical cavity 124 having a rectangular opening is located at one end of channel 122. Opening 49 is generally circular in configuration and is formed by a bore formed through the front surface 126 of front section 44. Opening 149 is provided with an inset ledge 128 and has a longitudinal channel 129 in order to mount lock assembly 50, as described below.

Similarly, back section 42 includes a trough 132 extending generally along a cord of back section 42. A half bore 134 extends radially and intersects trough 132 generally perpendicularly thereto. An upright post 136 is formed on the bottom of half bore 134 proximately to the perimeter of back section 42. A half bore 138, again of reduced radius of curvature is axial with and communicates with half bore 134. Half bore 138 is formed through boss 140 located on the outer edge of back section 42. Channel 142 is generally perpendicular to half bore 138 and intersects half bore 138. A half cylindrical cavity 144 having a rectangular opening is located at one end of channel 142 while the other end of channel 142 intersects lock cavity 148 that serves to mount lock assembly 50, as described below.

Figure 6:
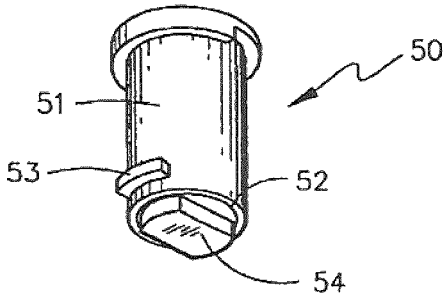
FIG. 6 is bottom perspective view of the key actuable lock assembly according to the exemplary embodiment.

With reference now to FIGS. 3 and 6, it may be seen that lock assembly 50 is of a type well known in the art. Lock assembly 50 includes an outer cylindrical shell casing 51 which rotatably receives a lock core 52 therein. Lock core 52 includes a generally rectangular post 54 projecting axially therefrom so that post 54 rotates with lock core 52 relative to casing 51. Casing 51 includes a radially outwardly projecting tab 53. A keyway 55 is located in lock core 52 opposite post 54 and, as is known in the art, when no key is inserted into keyway 55, lock core 52 is in a locked position wherein it may not rotate relative to casing 51. However, when a suitable key is inserted into keyway 55, lock core 52 may be rotated relative to casing 51 to an unlocked position. When assembled, lock assembly 50 resides in opening 49 and lock cavity 148. To this end, tab 53 engages channel 129,149 to prevent rotation of casing 51 relative to the lock body.

Figure 7:
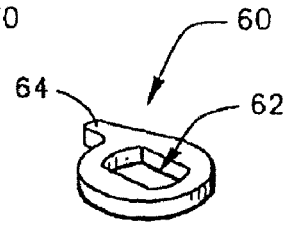
FIG. 7 is a perspective view of the cam element which mounts in the lock body.

With reference to FIGS. 3 and 7, it may be seen that rotatable cam 60 is generally in the form of a flat, circular washer having a generally rectangular opening 62 formed centrally therein. A cam lobe 64 projects outwardly from the outer edge of rotatable cam 60. When assembled, rotatable cam 60 mounts onto and is secured to lock core 52. To this end, post 54 engages rectangular opening 62 so that cam 60 rotates correspondingly with lock core 52. Cam element 60 is received in lock cavity 148 for rotation therein.

Figure 8:
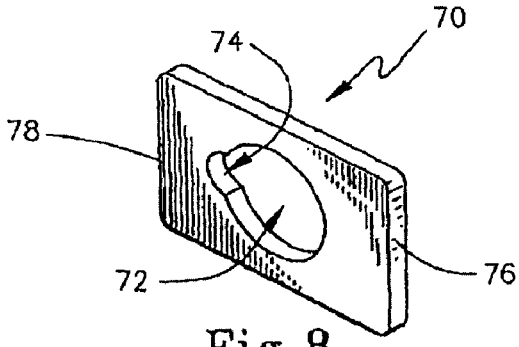
FIG. 8 is a perspective view of the latch element that mounts in the lock body.

With reference to FIGS. 3 and 8, it may be seen that the latch member, which in the exemplary embodiment is in the form of slide plate 70, is a rectangular plate having a circular opening 72 formed centrally therein. Opening 72 is sized to be slightly larger than latch head 26 so that latch head 26 may pass therethrough. A cutout or bay 74 is formed at a smaller radius curvature, corresponding to but slightly larger than the radius of curvature of post 24 of shackle member 14. Latch plate 70 is slideably received in the cavity formed by channels 122 and 142 when the lock body is assembled. Lobe 64 of cam element 60 abuts the side edge 76 of slide plate 70 when in the locked position and, as described below, acts to advance latch plate 70 to an unlatched state when the lock core is rotated to the unlock position. Spring 71 is received in cavities 124 and 144 and biases against edge 78 of slide plate 70 so as to bias slide plate 70 into the latch state.

Figure 9:
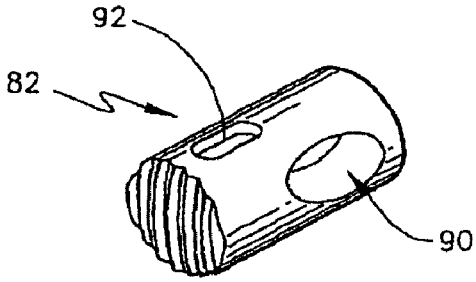
FIG. 9 is a perspective view of the release plunger according to the exemplary embodiment of the present invention.

A grip member in the form of a first plunger 82 is illustrated in FIGS. 3 and 9. Here, it may be seen that first plunger 82 is a generally cylindrical body having a transverse bore 90 formed adjacent to an inner end thereof. Bore 90 is sized and adapted to receive cable 12 therethrough in a sliding relationship. A pair of diametrically opposite slots 92 are formed in the side surface of first plunger 82 and are rotationally offset from bore 90 by ninety degrees. When assembled, slots 92 engage posts 116 and 136 so that first plunger 82 may radially reciprocate in lock body 40 but posts 116 and 136 act to retain first plunger 82 against removal from the lock body. To this end, it should be appreciated that, when assembled, half bores 114 and 134 form a cylindrical slideway which intersects the cylindrical throughway formed by troughs 112 and 132. First plunger 82 thus reciprocates in the slideway between a release state wherein bore 90 is aligned with the throughway formed by troughs 112 and 132 and a grip state wherein bore 90 is offset from the throughway formed by troughs 112 and 132. Spring 86 is received in the slide way and acts to bias first plunger 82 toward the grip state.

Figure 10:
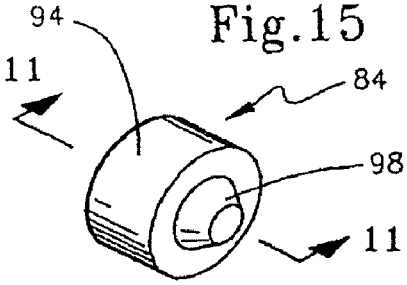
FIG. 10 is a perspective view of the second plunger according to the exemplary embodiment of the present invention.
Figure 11:
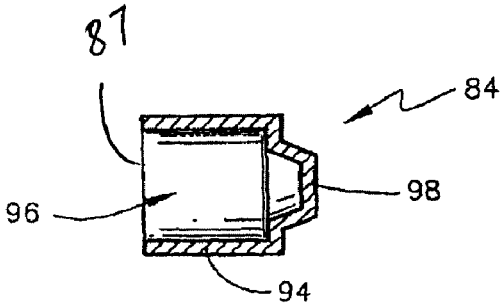
FIG. 11 is a cross-sectional view taken about lines 11-11 of FIG. 10.

A second plunger is also positioned in the slide way formed by half bores 114 and 134 with second plunger 84 being illustrated in FIGS. 3, 10 and 11. Here, it may be appreciated that second plunger 84 has a generally cylindrical sidewall 94 and a hollow interior 96. The closed end of second plunger 84 includes a truncated nose 98. Second spring 88 is received in interior 96 and, when assembled, (see FIGS. 13 and 15) is interposed between first plunger 82 and second plunger 84. Spring 88 rests on nub 100 of first plunger 82 so as to bias plungers 82 and 84 apart from one another.

Figure 12:
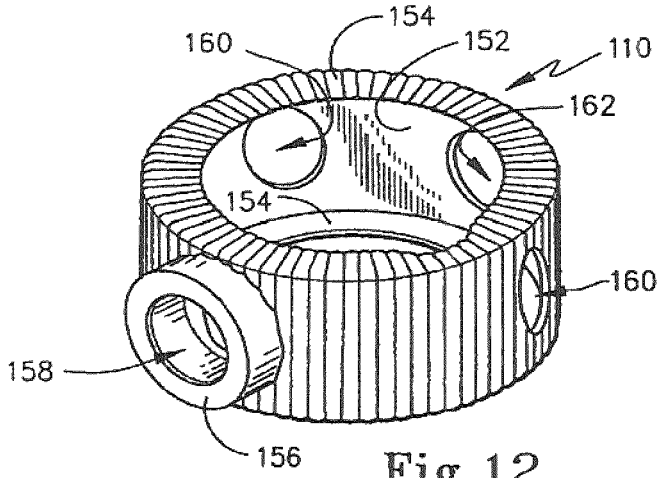
FIG. 12 is a perspective view of the soft grip covering for the lock body according to the exemplary embodiment of the present invention.

Cover 110 is illustrated in greater detail in FIG. 12 where it may be seen that cover 110 is generally an annular member having a cylindrical sidewall 152 sided with opposite flanges 154 to engage lock body 40. A cylindrical portion 156 projects radially outwardly from sidewall 152 so as to receive bosses 120 and 140 therein. Cylindrical portion 156 includes an opening 158 provided to allow shackle member 14 to be inserted therethrough. A pair of openings 160 are provided to register with the throughway formed by troughs 112 and 132 and another opening 162 is provided to register with the outer opening of the slide way formed by half bores 114 and 134.

Figure 13:
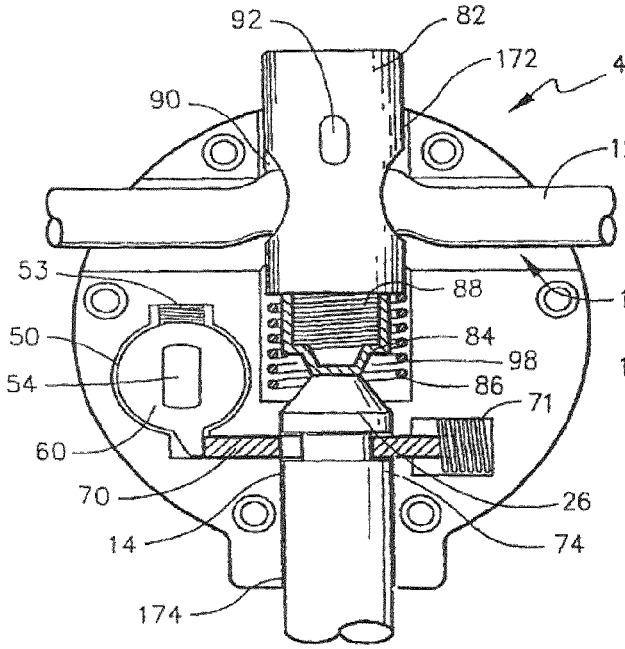
FIG. 13 is a front view in partial cross-section showing various assemblies disposed in the lock body according to the exemplary embodiment of the present invention with the shackle portion in an engaged state, with the grip member (first plunger) in a grip state and with the latch member in a latch state.
Figure 14:
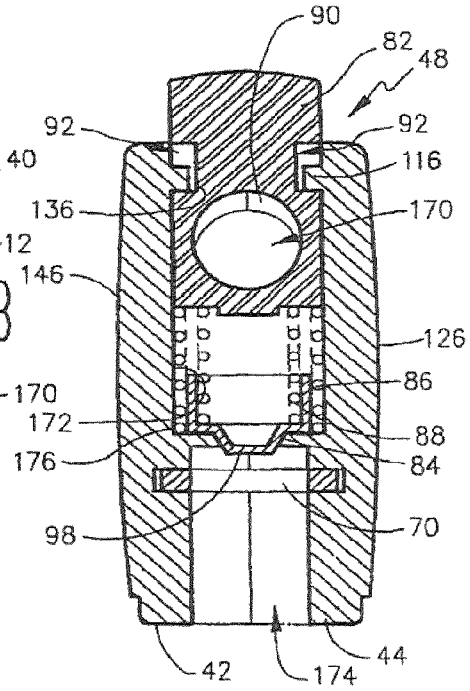
FIG. 14 is a side view in cross-section showing the lock body according to the exemplary embodiment of the present invention with the shackle member disengaged therefrom.
Figure 15:
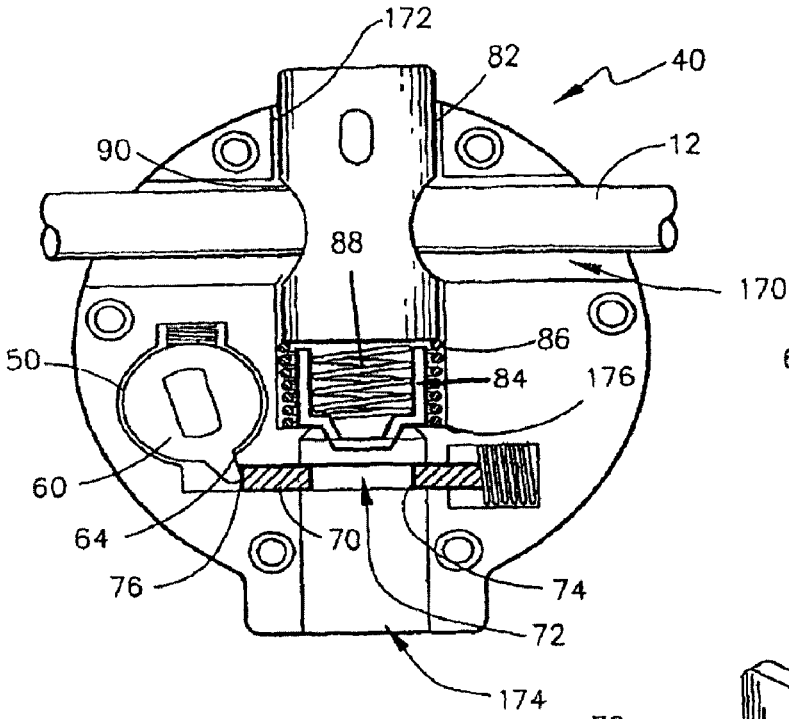
FIG. 15 is a cross-sectional view, similar to FIG. 13, but without the shackle portion and showing the cam element advancing the latch member to the unlatched state.

The assembly and operation of lock head 40 may be understood with greater detail with reference to FIGS. 13-15. Here, it may be seen that throughway 170 is sized and adapted to receive cable 12 therethrough. First plunger 82 and second plunger 84 are received in slideway 172 formed by opposed half bores 114 and 134 while a shackle passageway or opening 174 is formed by opposed half bores 118 and 138. First plunger 82 is slideably moveable between a grip state illustrated in FIGS. 13 and 14 wherein bore 90 is offset from throughway 170 thus kinking a portion of the cable and binding it so that the lock body is secured along cable 12 at a selected position. Plunger 82 may be moved radially inwardly to a release state, shown in FIG. 15, wherein bore 90 is aligned with throughway 170 so that cable 12 may slide through lock body 40 and through first plunger 82 allowing the lock body to be moved to a selected position along the length of cable 12. Spring 86 biases first plunger 82 toward the grip state and, to this end, bears again first plunger 82 and shoulder 176 at the interior end of slide way 172. As is seen in FIG. 14, spring 86 biases first plunger 82 toward the grip state so that, upon the release of plunger 82, cable 12 passing therethrough will be gripped to secure the lock body along the cable at the selected position.

The latch member, in the form of latch plate 70 moves between a latch state shown in FIG. 13 to an unlatch state shown in FIG. 15. When shackle portion 14 is received in shackle opening 174 and slide plate 70 is in the latch position, post 24 is received in bay 74 so that latch plate 70 engages the annular groove 28 of the shackle portion 14 thereby to lock the shackle portion relative to the lock body. This occurs when cam element 60 is in a first rotational orientation corresponding to the lock position of lock assembly 50.

However, when lock assembly 50 is rotated to the unlock position, as is shown in FIG. 15, cam element 60 moves to a second rotational position wherein lobe 64 abuts edge 76 of latch plate 70 so as to move plate 70 such that opening 72 is in alignment with shackle opening 174. This permits disengagement of latch head 26 from latch plate 70 allowing shackle portion 14 to disengaged from the lock body. To this end, also, spring 88 biases second plunger 84 to an advanced, position shown in FIG. 14. Nose 98 along with the spring force of spring 88 assists in ejecting shackle portion 14 from lock body 40. Moreover, with reference again to FIG. 13, it may be seen that, when shackle portion 14 is in the engaged state, latch head 26 bears against nose 98 to advance second plunger 84 into a retracted position compressing spring 88. Rim 87 (FIG. 11) of second plunger 84 abuts first plunger 82 when in the retracted position and maintains first plunger 82 in the grip state. Thus, when shackle portion 14 is engaged by the lock body 40, cable 12 is secured against sliding movement relative to throughway 170 and bore 90 since first plunger 82 can no longer move from the grip state to the release state. In addition, when cam element 60 is in the latch state, spring 71 bears against edge 78 of latch plate 70 to bias latch plate 70 into the latch state.

Figure 16:
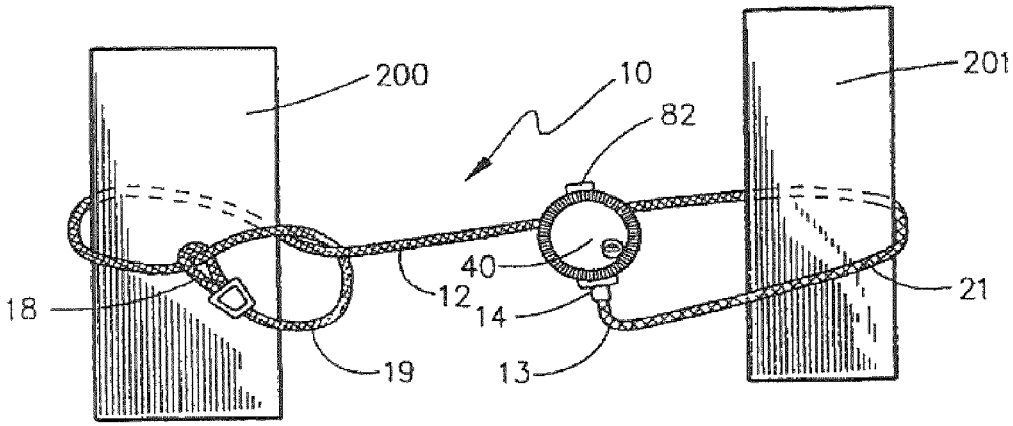
FIG. 16 illustrates a first locking configuration for the lock apparatus according to the exemplary embodiment of the present invention.
Figure 17:
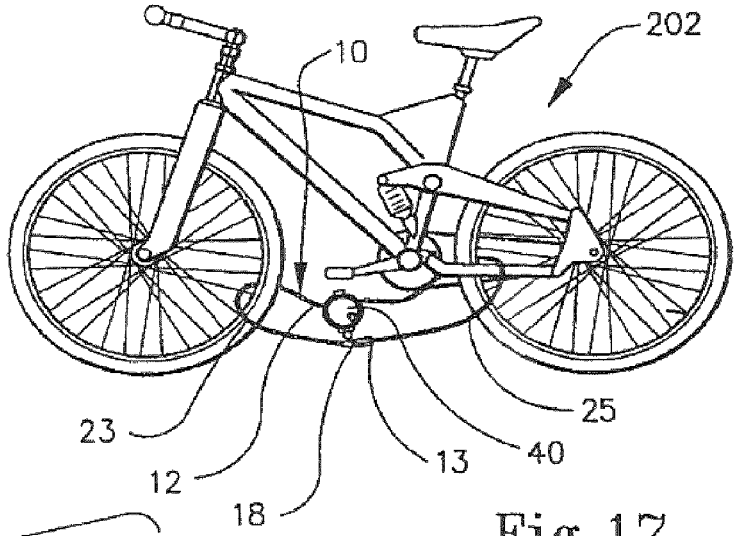
FIG. 17 is a side view in elevation illustrating a second configuration of the lock apparatus according to the exemplary embodiment of the present invention.
Figure 18:
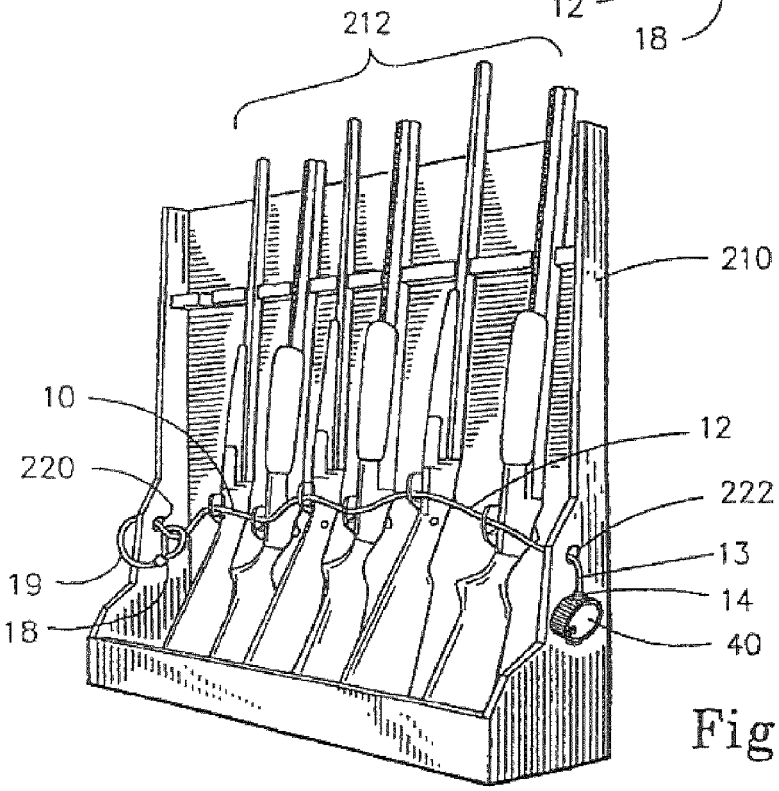
FIG. 18 illustrates yet another possible configuration of the lock apparatus according to the exemplary embodiment of the present invention.

With reference now to FIGS. 16-18, it may be seen that cable lock 10 may lock items using a variety of configurations. In FIG. 16, two items 200 and 201 are secured together by cable lock 10. In this configuration, the first end 13 of cable 12 is passed through loop 18 to create a larger loop 19. Cable 12 is then looped or encircled around first item 200 and passed through loop 19. Shackle portion 14 is then passed through the throughway in lock body 40 by depressing plunger 82 until it is positioned at a desired location. Cable 12 is then looped around second item 201 to form large loop 21 and shackle portion 14 is locked into lock body 40.

In FIG. 17, a bicycle 202 is locked by passing cable 12 through lock body 40 in the manner described above so that lock body 40 is positioned generally medially on cable 12. End 13 of cable 12 is then passed through loop 18 and is locked into lock body 40 to create two large loops 23 and 25 to secure the bicycle.

Finally, in FIG. 18, a plurality of rifles/shotguns 212 are secured to a gun rack 210 by passing first end 13 of cable 12 through a first opening 220 and then through loop 18 to create a small loop such as loop 19 that is secured to the gun rack 210. First end 13 of cable 12 is then threaded through the trigger assemblies or each of the guns 212 and then through a second opening 222 formed in gun rack 210. Shackle portion 14 is then directly locked to lock body 40 to prevent removal of cable lock 10 from the gun rack 210.

From the foregoing, it should be appreciated that the cable lock 10 according to the present invention also contemplates a method of securing an item with an elongated cable. This method can include any of the steps as described above or inherent in the exemplary embodiment. Broadly, the method according to the exemplary embodiment includes, in no particular order, the step of passing a first end of a cable through a lock body and advancing the lock body along the cable to a selected position. The method includes the step of forming a portion of the cable into a loop while engaging the item with a loop so as to prevent removal of the item therefrom. The first end of the elongated cable is lockably secured to the lock body to define a lock state wherein the item cannot be disengaged from the loop. Finally, the lock body is secured against movement along the cable when in the locked state. In addition to this general method, the cable may have a close looped formed on a second end thereof. Here, looping the cable around the item and then passing the first end of the cable through the closed loop accomplish the step of forming a portion of the cable into a loop while engaging the item with a loop. Wherein the item is to be secured to a second item, the method may be accomplished by first looping the cable around the item and then passing the first end of the cable through the closed loop and thereafter looping the cable around the second item and lockably securing the first end of the elongated cable to the lock body.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A lock apparatus, comprising:

a. an elongated flexible cable having a first end portion and an opposite second end portion defining a length therebetween and including a shackle portion affixed to said first end portion;

b. a lock body having a throughway that is sized and adapted to receive said cable in sliding relation such that said lock body may be selectively positioned along the length of said cable, said lock body having a shackle opening therein that is sized and adapted to receive said shackle portion in an engaged state with said shackle portion removable therefrom to define a disengaged state;

c. a grip assembly disposed in said lock body and including a grip member movable between a grip state wherein said lock body is secured along said cable at a selected position and a release state wherein said lock body may be advanced along said cable when said cable is received in the throughway;

d. a latch assembly disposed in said lock body and including a latch member movable between a latch state and an unlatch state such that, when said shackle portion is in the received state, said latch member is operative in the latch state to engage said shackle portion thereby to lock said shackle portion relative to said lock body and to release said shackle portion when in the unlatch state so that said shackle portion may be disengaged from said lock body;

e. a rotatable cam element disposed in said lock body and positioned so that when rotated in a first direction, said cam element drives said latch member from the latch state to the unlatch state; and f. a lock assembly disposed in said lock body, said lock assembly including a rotatable lock core which is operative to rotate said cam element, and which rotates between a lock position and an unlock position such that, when said lock assembly is in the lock position, said latch member is placed in the latch state and when said lock assembly is moved to the unlock position, said latch member is advanced from the latch state to the unlatch state.

2. A lock apparatus, comprising:

a. an elongated flexible cable having a first end portion and an opposite second end portion defining a length therebetween and including a shackle portion affixed to said first end portion;

b. a lock body having:

a throughway that is sized and adapted to receive said cable in sliding relation such that said lock body may be selectively positioned along the length of said cable;

a slideway formed therein which intersects the throughway; and a shackle opening therein that is sized and adapted to receive said shackle portion in an engaged state with said shackle portion removable therefrom to define a disengaged state;

c. a grip assembly disposed in said lock body and including a grip member movable between a grip state wherein said lock body is secured along said cable at a selected position and a release state wherein said lock body may be advanced along said cable when said cable is received in the throughway, said grip member being a first plunger slideably received in the slideway and slideably movable between the grip state and the release state, said first plunger having a bore formed transversely therethrough that is sized and adapted to receive said cable in sliding relationship such that, when said first plunger is in the release state, said bore aligns with the throughway whereby said cable may slide through said lock body and through said first plunger yet, when said first plunger is in the grip state, the bore is offset from said throughway thereby resisting sliding movement of said cable through said lock body and said first plunger, and wherein the shackle opening is aligned with said slideway, said shackle portion, when in the engaged state, operative to prevent said first plunger from moving from the grip state to the release state;

d. a second plunger disposed in said slideway and movable relative to said first plunger between a retracted position and an advanced position, said shackle portion operative to move said second plunger to the retracted position when in the engaged state whereby said first plunger is prevented from moving from the grip state to the release state;

e. a latch assembly disposed in said lock body and including a latch member movable between a latch state and an unlatch state such that, when said shackle portion is in the received state, said latch member is operative in the latch state to engage said shackle portion thereby to lock said shackle portion relative to said lock body and to release said shackle portion when in the unlatch state so that said shackle portion may be disengaged from said lock body; and f. a lock assembly disposed in said lock body and movable between a lock position and an unlock position such that, when said lock assembly is in the lock position, said latch member is placed in the latch state and when said lock assembly is moved to the unlock position, said latch member is advanced from the latch state to the unlatch state.

3. A lock apparatus according to claim 2 including a spring interposed between said first and second plungers and operative to bias said second plunger toward the advance position.

4. A lock apparatus according to claim 2 including a spring disposed in said lock body and operative to bias said plunger toward the grip state.

5. A lock apparatus according to claim 2 wherein said grip member is biased toward the grip state.

6. A lock apparatus according to claim 2 wherein said latch member is biased toward the latch state.

7. A lock apparatus according to claim 2 wherein said shackle portion, when in the engaged state, is biased towards the disengaged state.

8. A lock apparatus according to claim 2 including a stop head on said second end portion of said cable, said stop head sized such that it may not pass through said throughway.

9. A lock apparatus according to claim 8 wherein said stop head is defined by a closed loop portion of said cable.

10. A lock apparatus according to claim 2 wherein said lock body is configured as a generally disc-shaped structure having opposite generally parallel front and back surfaces and a cylindrical side surface therebetween, said throughway being defined by a first bore extending between two locations on said side surface, said shackle opening being formed through said side surface at a third location and having a lock opening formed through the front surface.

11. A lock apparatus according to claim 2 wherein said lock assembly is key actuable.

12. A lock apparatus according to claim 2 including a covering extending around a portion of said lock body, said covering formed of a soft-grip material.

13. A lock apparatus according to claim 2 wherein said lock body is formed by first and second mating sections.

14. A lock apparatus, comprising:

a. an elongated flexible cable having a first end portion and an opposite second end portion defining a length therebetween and including a shackle portion affixed to said first end portion;

b. a lock body having:

a throughway sized and adapted to receive said cable in sliding relation such that said lock body may be selectively positioned along the length of said cable;

a slideway formed therein which intersects the throughway; and a shackle opening therein that is aligned with said slideway, said shackle opening sized and adapted to receive said shackle portion in an engaged state with said shackle portion removable therefrom to define a disengaged state;

c. a grip assembly disposed in said lock body and including a grip member movable between a grip state wherein said lock body is secured along said cable at a selected position and a release state wherein said lock body may be advanced along said cable when said cable is received in the throughway, said grip member being a first plunger slideably received in the slideway and slideably movable between the grip state and the release state, said first plunger having a bore formed transversely therethrough that is sized and adapted to receive said cable in sliding relationship such that, when said first plunger is in the release state, said bore aligns with the throughway whereby said cable may slide through said lock body and through said first plunger yet, when said first plunger is in the grip state, the bore is offset from said throughway thereby resisting sliding movement of said cable through said lock body and said first plunger, said shackle portion, when in the engaged state, operative to prevent said first plunger from moving from the grip state to the release state;

d. a second plunger disposed in said slideway and movable relative to said first plunger between a retracted position and an advanced position, said shackle portion operative to move said second plunger to the retracted position when in the engaged state whereby said first plunger is prevented from moving from the grip state to the release state;

e. a spring interposed between said first and second plungers and operative to bias said second plunger toward the advanced position;

f. a latch assembly disposed in said lock body and including a latch member movable between a latch state and an unlatch state such that, when said shackle portion is in the received state, said latch member is operative in the latch state to engage said shackle portion thereby to lock said shackle portion relative to said lock body and to release said shackle portion when in the unlatch state so that said shackle portion may be disengaged from said lock body; and g. a lock assembly disposed in said lock body and movable between a lock position and an unlock position such that, when said lock assembly is in the lock position, said latch member is placed in the latch state and when said lock assembly is moved to the unlock position, said latch member is advanced from the latch state to the unlatch state.

15. A lock apparatus, comprising:

a. an elongated flexible cable having a first end portion and an opposite second end portion defining a length therebetween and including a shackle portion affixed to said first end portion and a stop head on said second end portion;

b. a lock body having:

a throughway that is sized and adapted to receive said cable in sliding relation such that said lock body may be selectively positioned along the length of said cable;

a slideway formed therein which intersects the throughway; and a shackle opening therein that is sized and adapted to receive said shackle portion in an engaged state with said shackle portion removable therefrom to define a disengaged state;

c. a first plunger slideably received in the slideway and movable between a grip state and a release state, said first plunger having a bore formed transversely therethrough that is sized and adapted to receive said cable in sliding relationship such that, when said first plunger is in the release state, said bore aligns with the throughway whereby said cable may slide through said lock body and through said first plunger yet, when said first plunger is in the grip state, the bore is offset from said throughway thereby resisting sliding movement of said cable through said lock body and said first plunger, said shackle opening being aligned with said slideway, said shackle portion, when in the engaged state, operative to prevent said first plunger from moving from the grip state to the release state;

d. a second plunger disposed in said slideway and movable relative to said first plunger between a retracted position and an advanced position, said shackle portion operative to move said second plunger to the retracted position when in the engaged state whereby said first plunger is prevented from moving from the grip state to the release state;

e. a latch assembly disposed in said lock body and including a latch member movable between a latch state and an unlatch state such that, when said shackle portion is in the engaged state, said latch member is operative in the latch state to engage said shackle portion thereby to lock said shackle portion relative to said lock body and to release said shackle portion when in the unlatch state so that said shackle portion may be disengaged from said lock body; and f. a lock assembly disposed in said lock body and movable between a lock position and an unlock position such that, when said lock assembly is in the lock position, said latch member is placed in the latch state and when said lock assembly is moved to the unlock position, said latch member is advanced from the latch state to the unlatch state.

16. A lock apparatus according to claim 15 wherein said stop head is defined by a closed loop portion of said cable.

17. A lock apparatus according to claim 15 wherein said first plunger is biased toward the grip state.

18. A lock apparatus according to claim 15 wherein said latch member is biased toward the latch state.

19. A lock apparatus according to claim 15 including a rotatable cam element disposed in said lock body and positioned so that when rotated in a first direction, said cam element drives said latch member from the latch state to the unlatch state, said lock assembly including a rotatable lock core which rotates between the lock position and the unlock position, said lock core operative to rotate said cam element.

20. A lock apparatus, comprising:

a. an elongated flexible cable having a first end portion and an opposite second end portion defining a length therebetween and including a shackle portion affixed to said first end portion;

b. a generally disc-shaped lock body having opposite generally parallel front and back surfaces and a cylindrical side surface extending therebetween, said lock body having a throughway extending between spaced first and second locations on the side surface along a cord of said disc-shaped lock body, said throughway being sized and adapted to receive said cable in sliding relation therethrough such that said lock body may be selectively positioned along the length of said cable, said lock body having a shackle bore formed radially through said side surface generally perpendicular to said throughway at a third location therein, said shackle bore being sized and adapted to receive said shackle portion in an engaged state with said shackle portion removable therefrom to define a disengaged state, said lock body further having a plunger bore formed radially through the sidewall thereof with said plunger bore aligned with said shackle bore and intersecting the throughway;

c. a grip assembly disposed in said lock body and including a grip member movable between a grip state wherein said lock body is secured along said cable at a selected position and a release state wherein said lock body may be advanced along said cable when said cable is received in the throughway, said grip member being a first plunger slideably received in the plunger bore and slideably movable between the grip state and the release state, said shackle portion, when in the engaged state, is operative to prevent said first plunger from moving from the grip state to the release state;

d. a second plunger disposed in said plunger bore and movable relative to said first plunger between a retracted position and an advanced position, said shackle portion operative to move said second plunger to the retracted position when in the engaged state whereby said first plunger is prevented from moving from the grip state to the release state;

e. a latch assembly disposed in said lock body and including a latch member movable between a latch state and an unlatch state such that, when said shackle portion is in the received state, said latch member is operative in the latch state to engage said shackle portion thereby to lock said shackle portion relative to said lock body and to release said shackle portion when in the unlatch state so that said shackle portion may be disengaged from said lock body; and f. a lock assembly disposed in said lock body and movable between a lock position and an unlock position such that, when said lock assembly is in the lock position, said latch member is placed in the latch state and when said lock assembly is moved to the unlock position, said latch member is advanced from the latch state to the unlatch state.

21. A lock apparatus according to claim 20 wherein said first plunger has a cable bore formed transversely therethrough that is sized and adapted to receive said cable in sliding relationship such that, when said first plunger is in the release state, said cable bore aligns with the throughway whereby said cable may slide through said lock body and through said first plunger yet, when said first plunger is in the grip state, the cable bore is offset from said throughway thereby resisting sliding movement of said cable through said lock body and said first plunger.

22. A lock apparatus according to claim 20 wherein said lock body is formed by first and second mating sections.

23. A lock apparatus, comprising:

a. an elongated flexible cable having a first end portion and an opposite second end portion defining a length therebetween and including a shackle portion affixed to said first end portion and a stop head on said second end portion;

b. a lock body having a throughway that is sized and adapted to receive said cable in sliding relation such that said lock body may be selectively positioned along the length of said cable;

a slideway formed therein which intersects the throughway;

a shackle opening therein that is sized and adapted to receive said shackle portion in an engaged state with said shackle portion removable therefrom to define a disengaged state; and a rotatable cam element disposed on said lock body;

c. a first plunger slideably received in the slideway and movable between a grip state and a release state, said first plunger having a bore formed transversely therethrough that is sized and adapted to receive said cable in sliding relationship such that, when said first plunger is in the release state, said bore aligns with the throughway whereby said cable may slide through said lock body and through said first plunger yet, when said first plunger is in the grip state, the bore is offset from said throughway thereby resisting sliding movement of said cable through said lock body and said first plunger;

d. a latch assembly disposed in said lock body and including a latch member movable between a latch state and an unlatch state such that, when said shackle portion is in the engaged state, said latch member is operative in the latch state to engage said shackle portion thereby to lock said shackle portion relative to said lock body and to release said shackle portion when in the unlatch state so that said shackle portion may be disengaged from said lock body, said rotatable cam positioned so that, when rotated in a first direction, said cam element drives said latch member from the latch state to the unlatch state; and e. a lock assembly disposed in said lock body and movable between a lock position and an unlock position such that, when said lock assembly is in the lock position, said latch member is placed in the latch state and when said lock assembly is moved to the unlock position, said latch member is advanced from the latch state to the unlatch state, said lock assembly including a rotatable lock core which rotates between the lock position and the unlock position, said lock core operative to rotate said cam element.

* * * * *